US007819788B1

(12) United States Patent
Ho et al.

(10) Patent No.: US 7,819,788 B1
(45) Date of Patent: Oct. 26, 2010

(54) EXERCISE APPARATUS FOR EXERCISING THE MUSCLES OF THE LIMBS, WAIST AND ABDOMEN

(76) Inventors: Wei-Teh Ho, P.O. Box 24-108, Taipei (TW); Wei-Yu Ho, P.O. Box 24-108, Taipei (TW)

( * ) Notice: Subject to any disclaimer, the term of this patent is extended or adjusted under 35 U.S.C. 154(b) by 0 days.

(21) Appl. No.: 12/583,235

(22) Filed: Aug. 18, 2009

(51) Int. Cl.
*A63B 21/02* (2006.01)

(52) U.S. Cl. ..... 482/122; 482/128

(58) Field of Classification Search ..... 482/91, 482/97, 121, 122, 123, 126, 128, 140, 907, 482/908; D21/673, 692, 694, 695
See application file for complete search history.

(56) References Cited

U.S. PATENT DOCUMENTS 5,913,756 A * 6/1999 Glaser ..... 482/128
6,814,690 B1 * 11/2004 Stearns ..... 482/52
7,306,547 B2 * 12/2007 Stearns ..... 482/91
7,357,763 B2 * 4/2008 Ho ..... 482/132
2006/0014614 A1 * 1/2006 Szabo et al. ..... 482/140
2006/0270535 A1 * 11/2006 Casey ..... 482/140

* cited by examiner

*Primary Examiner*—Loan Thanh
*Assistant Examiner*—Tam Nguyen
(74) *Attorney, Agent, or Firm*—Jackson IPG PLLC; Demian K. Jackson

(57) ABSTRACT

An exercising apparatus for exercising the muscles of the limbs, waist and abdomen includes an upright support with a pulley at the top, a handlebar with two grips arranged at the top and a middle part formed of a spring member, a linking device, which has a top end pivotally connected to the bottom end of the handlebar, a middle part pivotally connected to a lower part of the support and a bottom end pivotally mounted with two foot bars, and an expander extending over the pulley of the upright support and connected to between the handlebar and the support.

5 Claims, 5 Drawing Sheets

EXERCISE APPARATUS FOR EXERCISING THE MUSCLES OF THE LIMBS, WAIST AND ABDOMEN

BACKGROUND OF THE INVENTION

1. Field of the Invention

The present invention relates to exercising apparatus and more particularly, to a simple structure of exercising apparatus, which is practical for exercising the muscles of the limbs, waist and abdomen.

2. Description of the Related Art

Modern people pay much attention to body fitness. Many exercising apparatus are commercially available for different exercising purposes. However, conventional exercising apparatus for exercising the muscles of the limbs, waist and abdomen are commonly heavy and expensive.

SUMMARY OF THE INVENTION

The present invention has been accomplished under the circumstances in view. It is therefore the main object of the present invention to provide a simple structure of exercising apparatus, which is practical for exercising the muscles of the limbs, waist and abdomen. According to one aspect of the present invention, the exercising apparatus comprises an upright support with a pulley at the top, a handlebar with two grips at the top, a linking device, which has a top end pivotally connected to the bottom end of the handlebar, a middle part pivotally connected to a lower part of the support and a bottom end pivotally mounted with a detachable foot bar, and an expander extending over the pulley of the upright support and connected to between the handlebar and the support.

According to another aspect of the present invention, the handlebar has a middle part formed of a spring member for allowing adjustment of the length.

According to still another aspect of the present invention, the exercising apparatus further comprises a tension control device provided at the upright support for adjusting the stretch tension of the expander to fit different users or different exercising demands.

DETAILED DESCRIPTION OF THE PREFERRED EMBODIMENT

Figure 1:
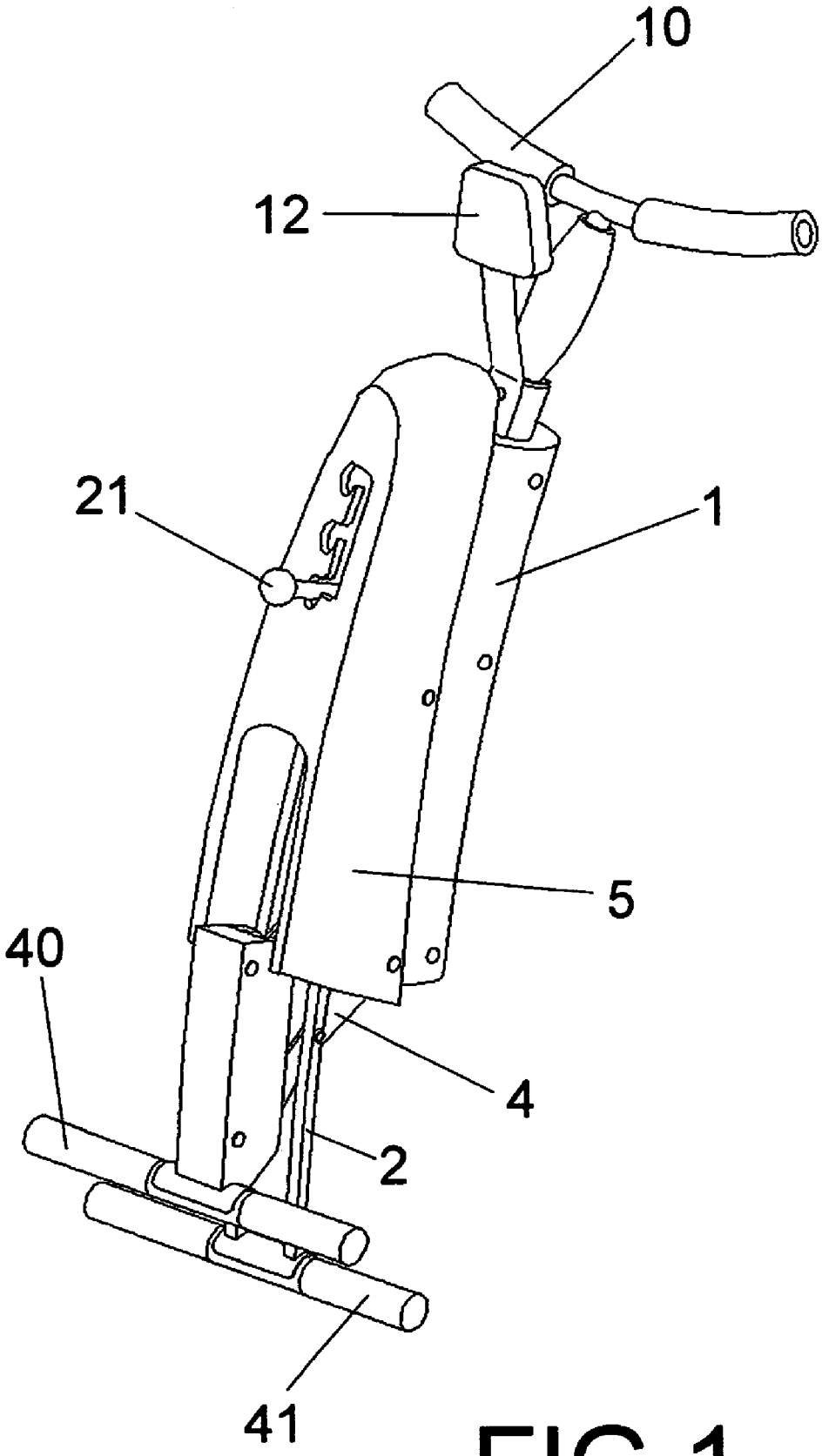
FIG. 1 is an elevational view of an exercising apparatus in accordance with the present invention.
Figure 2:
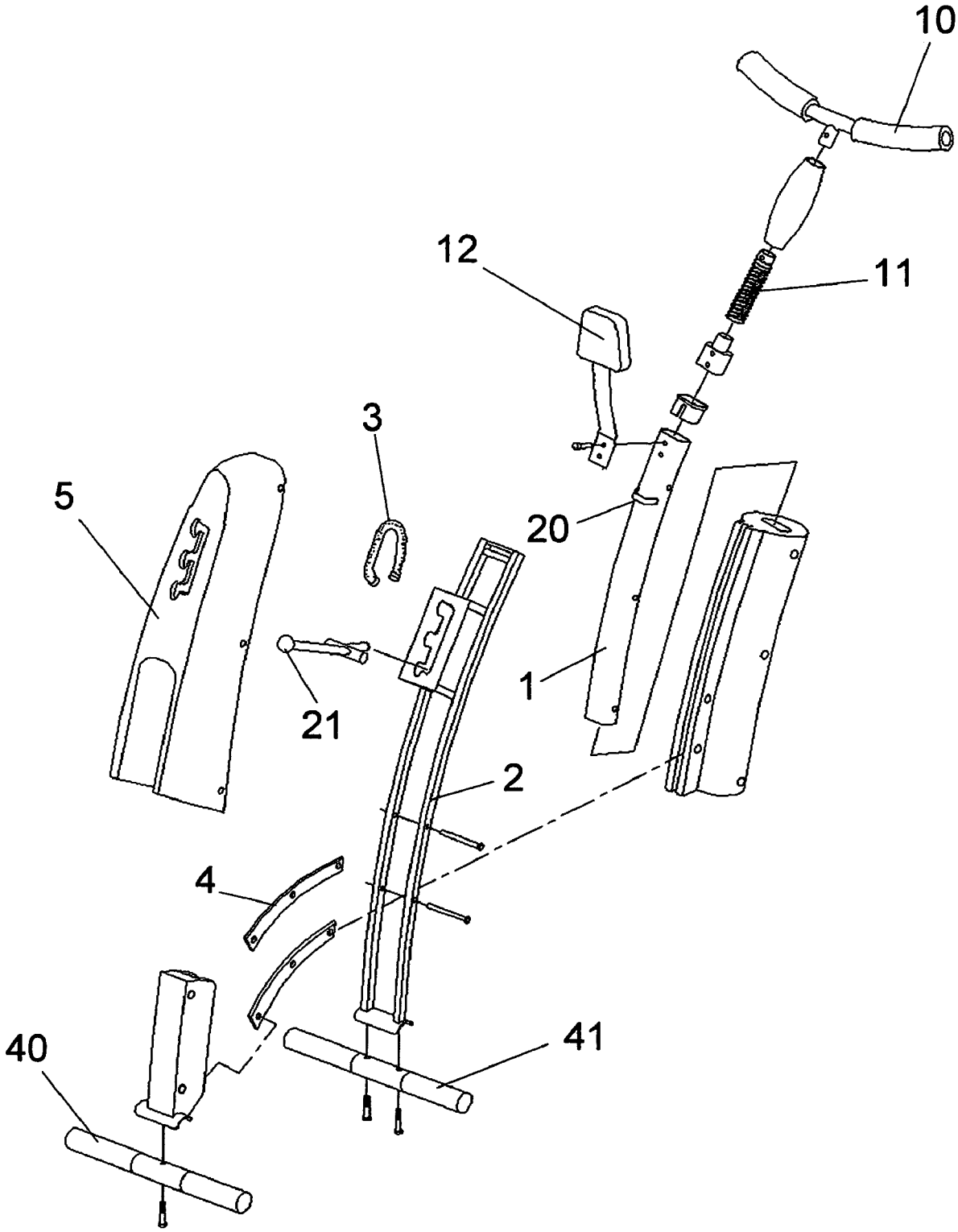
FIG. 2 is an exploded view of the exercising apparatus in accordance with the present invention.
Figure 3:
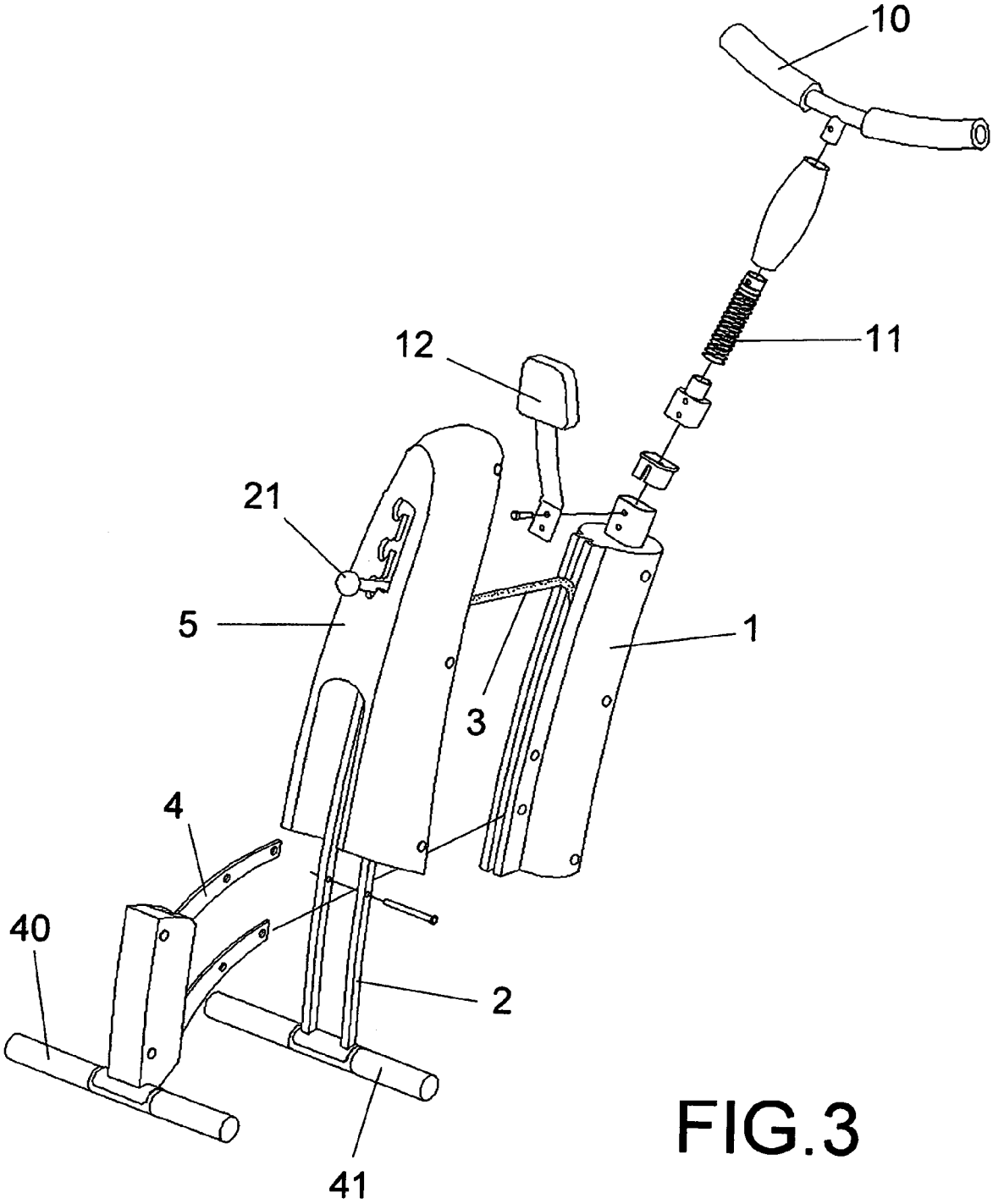
FIG. 3 is an elevational view of the present invention, showing the structure of the exercising apparatus after removal of the cover shell.
Figure 4:
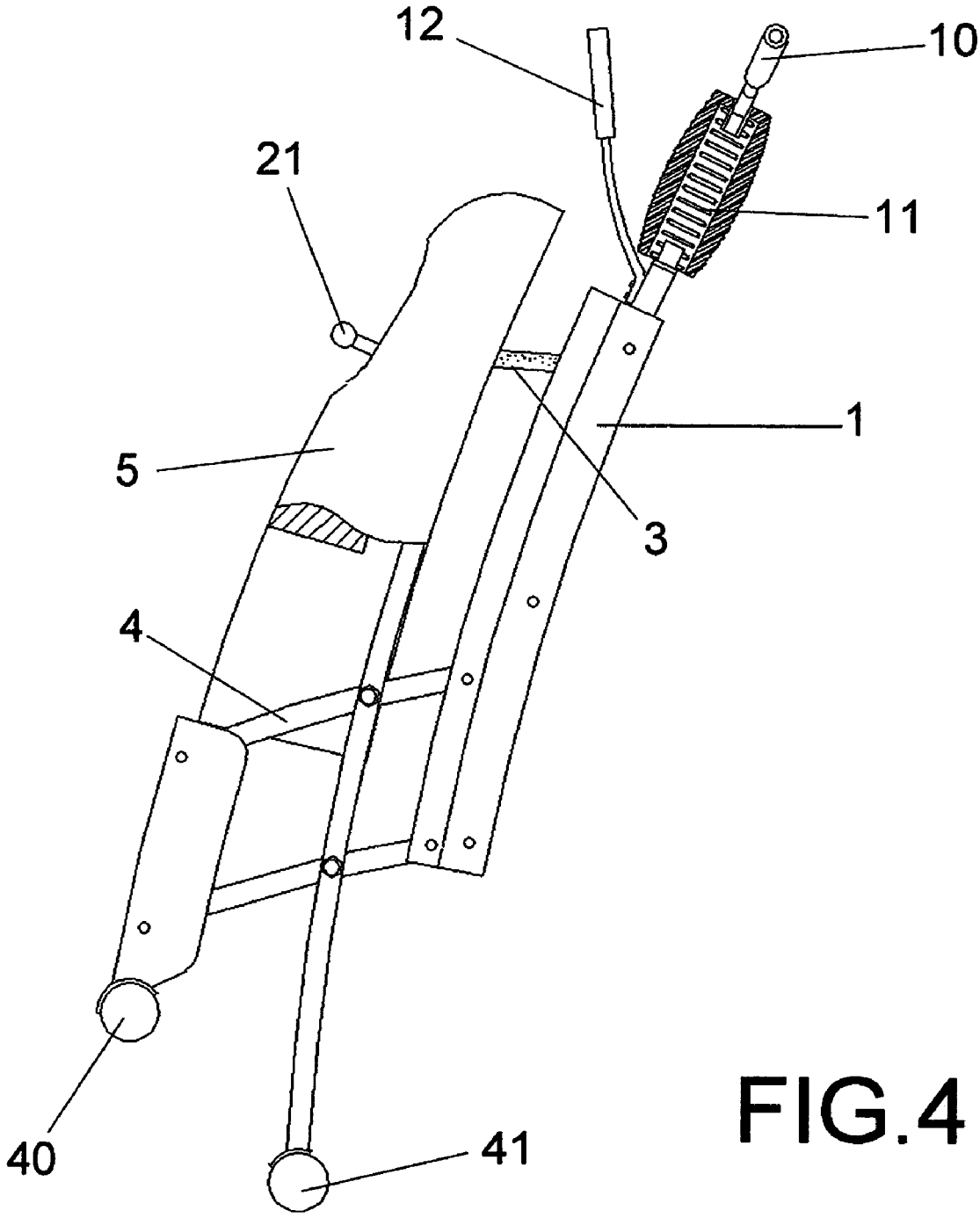
FIG. 4 is a side view of the exercising apparatus according to the present invention.
Figure 5:
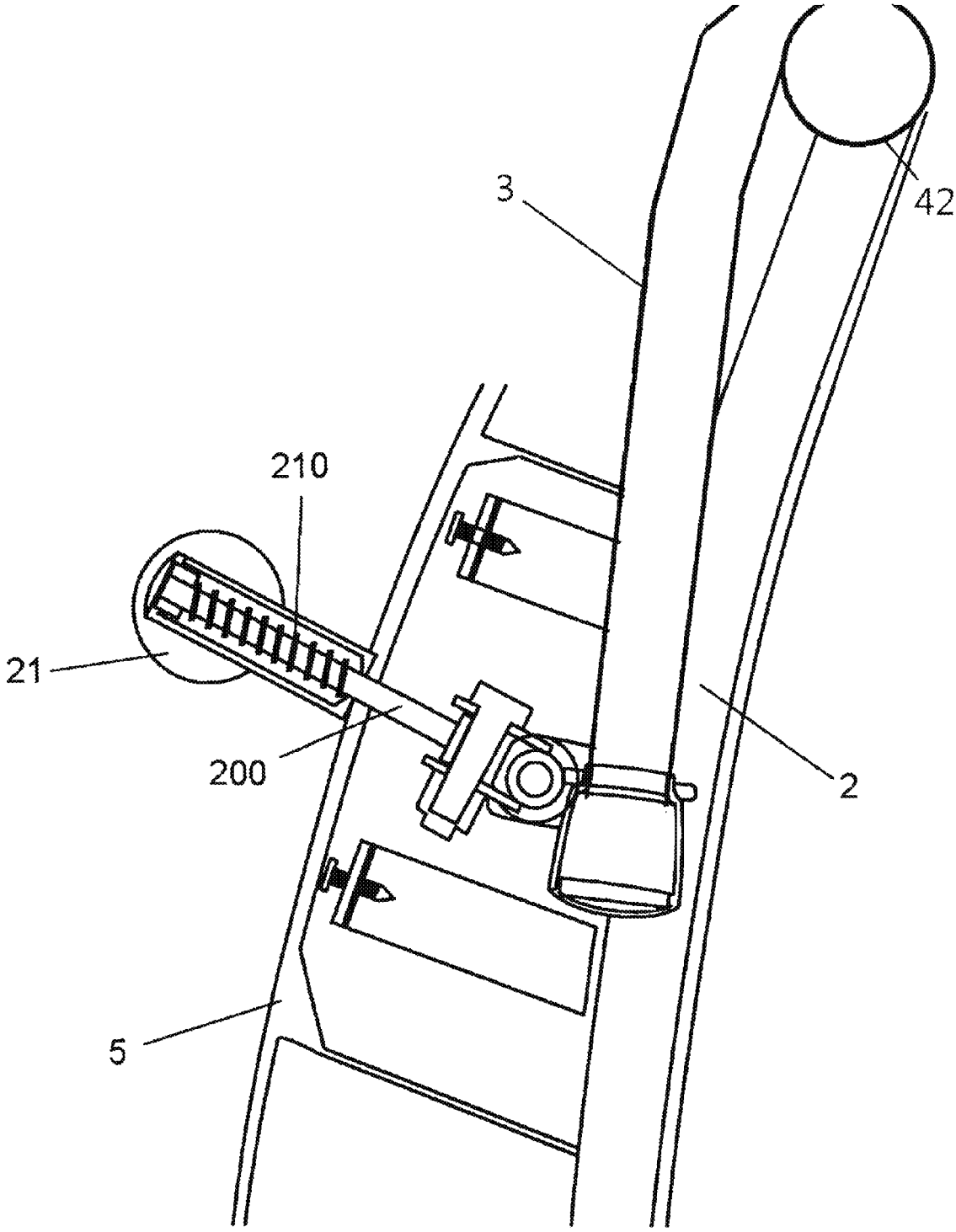
FIG. 5 is a sectional view in an enlarged scale of a part of the present invention, showing the structure of the tension control device.

Referring to FIGS. 1-5, an exercising apparatus in accordance with the present invention is shown comprised of a handlebar 1, an upright support 2, an expander 3 and a linking device 4.

The handlebar 1 has a middle part thereof formed of a spring member 11 for allowing adjustment of the length, a top end terminating in two grips 10 and a bottom end pivotally connected with the linking device 4. The linking device 4 has a top end pivotally connected to the bottom end of the handlebar 1, a middle part pivotally connected to a lower part of the upright support 2, and a bottom end mounted with a detachable foot bar 40 in such a manner that the detachable foot bar 40 is constantly kept above the elevation of the bottom side of the upright support 2. The upright support 2 has a detachable floor bar 41 detachably fastened to the bottom side thereof. The handlebar 1 has a fixed lug 20 protruded from the periphery and spaced above the elevation of the connection area between the handlebar 1 and the linking device 4. The expander 3 extends over a pulley 42 that is pivotally mounted in the top side of the upright support 2, having one end connected to the fixed lug 20 of the handlebar 1 and the other end fastened to a tension control device 21 at the upright support 2. The tension control device 21 is comprised of an adjustment rod 200 and a spring member 210, and operable to adjust the stretch tension of the expander 3. Further, one or more expanders may be added to change the stretch tension. Further, a cover shell 5 may be attached to the upright support 2, enhancing the sense of beauty. Further, a combination counter, timepiece and video electronic device 12 is provided at the top side of the handlebar 1.

When in use, the upright support 2 of the exercising apparatus is placed on the floor, and then the user is sitting on a chair near the upright support 2 and holding the grips 10 of the handlebar 1 with the hand and stepping the two feet on the foot bars 40. During exercise, the user applies a downward pressure to the handlebar 1 to compress the spring member 11 and to stretch the expander 3 and simultaneously to bias the linking device 4, causing the feet to be lifted with the foot bar 40. Thereafter, the user releases the pressure from the handlebar 1 for enabling the expander 3 to return the handlebar 1 and the spring member 11 and the linking device 4. This procedure is repeated again and again, thereby exercising the muscles of the limbs, waist and abdomen. Further, the user can adjust the stretch tension of the expander 3 and the length of the handlebar 1 subject to individual exercising demand. When not in use, the detachable foot bar 40 and the detachable floor bar 41 can be detached from the linking device 4 and the upright support 2 respectively, saving the cost.

Although particular embodiments of the invention have been described in detail for purposes of illustration, various modifications and enhancements may be made without departing from the spirit and scope of the invention. Accordingly, the invention is not to be limited except as by the appended claims.

The invention claimed is:

1. An exercising apparatus for exercising the muscles of the limbs, waist and abdomen comprising:

an upright support, said upright support having a bottom side mounted with a floor bar for supporting on a floor and a top side pivotally mounted with a pulley;

a handlebar, said handlebar having a top end provided with two grips, a bottom end and a spring member interconnected between the top end and the bottom end;

a linking device, said linking device having a top end pivotally connected to the bottom end of said handlebar, a middle part pivotally connected to a lower part of said upright support, and a bottom end mounted with a foot bar spaced apart from said floor bar of said upright support; and at least one expander extending over said pulley of said upright support, said at least one expander connecting said handlebar to said upright support.

2. The exercising apparatus for exercising the muscles of the limbs, waist and abdomen as claimed in claim 1, wherein said floor bar and said foot bar are detachable.

3. The exercising apparatus for exercising the muscles of the limbs, waist and abdomen as claimed in claim 1, wherein said upright support has a tension control device mounted thereon adapted for adjusting the stretch tension of said at least one expander.

4. The exercising apparatus for exercising the muscles of the limbs, waist and abdomen as claimed in claim 1, further comprising a cover shell fastened to said upright support.

5. The exercising apparatus for exercising the muscles of the limbs, waist and abdomen as claimed in claim 1, further comprising a combination counter, timepiece and video electronic device provided at the top end of the handlebar.

* * * * *